US011148871B2

(12) United States Patent
Sell et al.

(10) Patent No.: US 11,148,871 B2
(45) Date of Patent: Oct. 19, 2021

(54) AEROSOL ACTUATION SYSTEMS AND METHODS FOR MAKING THE SAME

(75) Inventors: Steven A. Sell, Belton, MO (US); Steven L. Sweeton, Winnebago, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 129 days.

(21) Appl. No.: 12/997,120

(22) PCT Filed: Jun. 9, 2009

(86) PCT No.: PCT/US2009/046668
§ 371 (c)(1),
(2), (4) Date: Jan. 21, 2011

(87) PCT Pub. No.: WO2009/152112
PCT Pub. Date: Dec. 17, 2009

(65) Prior Publication Data

US 2011/0108583 A1 May 12, 2011

Related U.S. Application Data

(60) Provisional application No. 61/060,323, filed on Jun. 10, 2008, provisional application No. 61/074,854, filed on Jun. 23, 2008, provisional application No. 61/114,316, filed on Nov. 13, 2008.

(51) Int. Cl.
*B65D 83/16* (2006.01)
*B65D 83/20* (2006.01)

(52) U.S. Cl.
CPC ..... *B65D 83/206* (2013.01)

(58) Field of Classification Search
CPC .. B65D 83/205; B65D 83/202; B65D 83/206; B65D 83/201; B65D 83/22; B65D 83/46; B65D 83/40; B05B 11/3057
USPC ..... 222/153.01, 153.02, 153.05, 153.06, 222/153.07, 402.11, 402.15, 403.13, 182, 222/402.13
See application file for complete search history.

(56) References Cited

U.S. PATENT DOCUMENTS 2,982,448 A * 5/1961 Leonard et al. ..... 222/153.07
3,137,414 A * 6/1964 Steinkamp ..... 222/182
3,211,384 A * 10/1965 Seaquist ..... 239/579
3,223,287 A * 12/1965 Sagarin ..... 222/153.06
3,225,966 A * 12/1965 Sagarin ..... 222/153.06
(Continued)

FOREIGN PATENT DOCUMENTS

EP 1726537A1 A1 11/2006
GB 2101692A A 1/1983

OTHER PUBLICATIONS

International Search Report for PCT/US2009046668, published Jul. 20, 2009.

(Continued)

*Primary Examiner* — Charles P. Cheyney
(74) *Attorney, Agent, or Firm* — Barlow, Josephs & Holmes, Ltd.

(57) ABSTRACT

An aerosol actuation system may include an aerosol actuator formed of a first molded component including a housing, a manifold connected to the housing and a button in communication with the manifold, and a molded cap. The aerosol actuator may be assembled with an aerosol container.

7 Claims, 12 Drawing Sheets

(56) References Cited

U.S. PATENT DOCUMENTS 3,367,540 A 2/1968 Lehmann
3,409,186 A * 11/1968 Melocchi ..... B65D 83/205 222/402.13
3,608,791 A 9/1971 Jordan
3,987,942 A * 10/1976 Morane ..... B65D 83/206 222/402.15
4,095,725 A * 6/1978 Goncalves ..... 222/153.06
4,456,153 A * 6/1984 Meshberg ..... B05B 11/3095 222/321.8
5,018,647 A * 5/1991 Abplanalf ..... B65D 83/206 222/108
5,027,982 A 7/1991 Demarest
5,114,052 A * 5/1992 Tiramani ..... B05B 11/0064 222/207
5,649,645 A * 7/1997 Demarest et al. ..... 222/153.07
5,730,332 A 3/1998 Zimmerhackel
5,791,524 A * 8/1998 Demarest ..... B65D 83/24 222/153.06
6,588,631 B2 * 7/2003 Sanchez ..... B65D 83/206 222/402.13
7,204,393 B2 * 4/2007 Strand ..... 222/402.13
7,621,468 B2 * 11/2009 Smith et al. ..... 239/492
7,882,990 B1 * 2/2011 Walters ..... B65D 83/206 222/185.1
9,061,817 B2 * 6/2015 Lind ..... B65D 83/206
2004/0222246 A1 11/2004 Bates et al.
2007/0034649 A1 * 2/2007 Smith ..... B65D 83/206 222/182
2008/0290113 A1 * 11/2008 Helf ..... B65D 83/24 222/52

OTHER PUBLICATIONS

International Preliminary Report on Patentability for PCT/US2009046668, published Jul. 8, 2009.
Extended European Search Report for PCT/US2009046668, published Sep. 22, 2011.

* cited by examiner

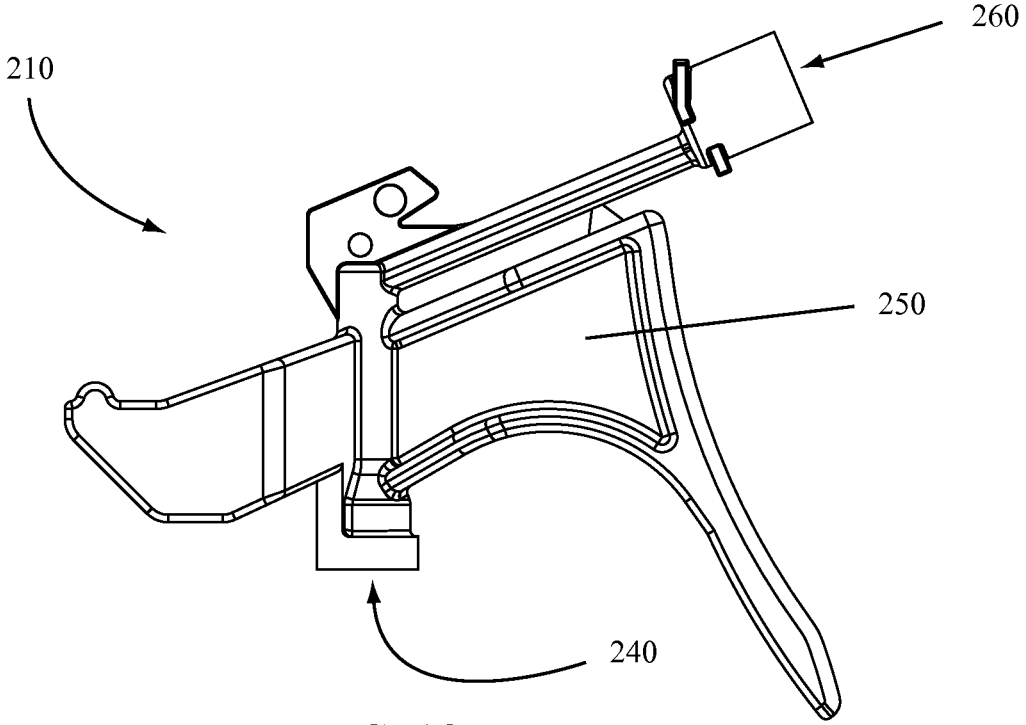
FIG. 18
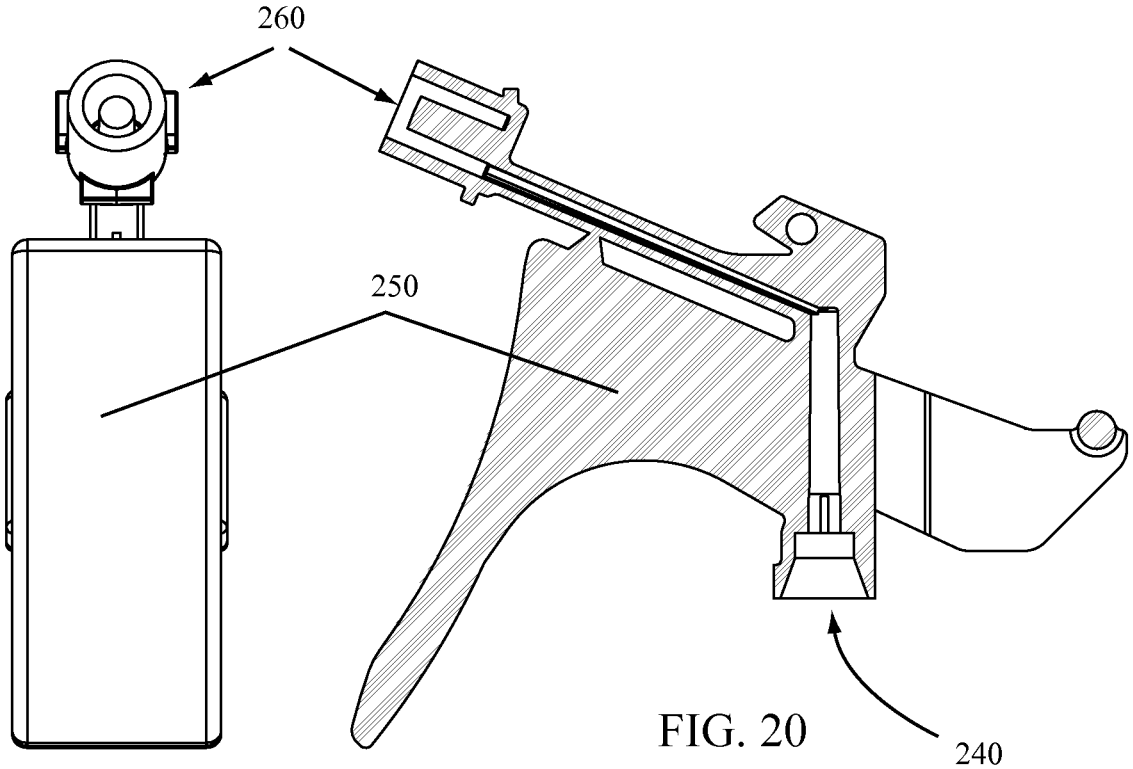
FIG. 19
FIG. 20

AEROSOL ACTUATION SYSTEMS AND METHODS FOR MAKING THE SAME

CROSS-REFERENCE TO RELATED APPLICATIONS

This application claims the benefit of U.S. Provisional Application No. 61/060,323, entitled "AEROSOL ACCTUATION SYSTEMS AND METHODS FOR MAKING THE SAME," filed 10 Jun. 2008, of U.S. Provisional Application No. 61/074,854, entitled "AEROSOL ACCTUATION SYSTEMS AND METHODS FOR MAKING THE SAME," filed 23 Jun. 2008, of U.S. Provisional Application No. 61/114,316, entitled "AEROSOL ACCTUATION SYSTEMS AND METHODS FOR MAKING THE SAME," filed 13 Nov. 2008, and International Application Number PCT/US09/46668, entitled "AEROSOL ACCTUATION SYSTEMS AND METHODS FOR MAKING THE SAME," filed 9 Jun. 2009, and incorporates each of those applications herein by reference in their entireties.

BACKGROUND OF THE INVENTION

1. Field of the Invention

Embodiments of the present invention relate to spray systems and more particularly to aerosol actuation systems, actuation mechanisms, and methods for making such systems.

2. State of the Art

Aerosol spray systems are well known. A traditional aerosol spray system may include an aerosol container, a valve, and an actuator. A product and gas contained within an aerosol container may be released by pressure exerted on the actuator, opening the valve and allowing the product and gas to escape as an aerosol. In many instances, the actuator is a button or cap having a fluid flow path therein which attaches to the valve of the aerosol system. When a user applies pressure to the button or cap, the valve opens allowing a product and gas to pass through the fluid flow path and exit the aerosol container.

The awkward ergonomics required to actuate some aerosol systems has led to the development of alternative actuation processes. For example, some aerosol systems are now actuated with elaborate trigger systems such as those disclosed and described in U.S. patent application Ser. No. 10/429,629 (Published as US 2004/0222246), now abandoned. Other trigger actuated systems have also been used. These systems, however, often use multiple parts, requiring multi-stage assembly processes. The increased part count and complicated assembly processes associated with these systems often increases the costs associated with producing aerosol actuation systems.

Therefore, it is desirable to develop improved aerosol actuation and spray systems and lower cost aerosol actuation and spray systems.

BRIEF SUMMARY OF THE INVENTION

According to certain embodiments of the invention, an aerosol actuation system may include an aerosol actuator attached to an aerosol container having a valve system. The aerosol actuator may include two or more molded pieces.

In some embodiments of the invention, an aerosol actuator may include a first molded component assembled with a second molded component. The first molded component may include a housing, a manifold, and a button. The second molded component may include a cap which may be attached to the first molded component. The first and second components may be made of similar or dissimilar materials. The first and second molded components may also have similar or dissimilar coloring.

According to other embodiments of the invention, a third component, such as an orifice cup, may be assembled with an aerosol actuator including a housing, a manifold, a button and a cap. An orifice cup may be used to alter the spray pattern of an aerosol actuator.

According to various embodiments of the invention, a button of the aerosol actuator may be connected or in communication with the manifold such that when a force is applied to the button, the manifold is moved and actuates a valve of an aerosol container to release a product or an aerosol from the aerosol container.

According to still other embodiments of the invention, a trigger and manifold used in an aerosol actuation system may be molded as a single part. In other embodiments, a trigger, manifold, and orifice cup or discharge orifice may be molded in a single part or as a unitary piece.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following description of the invention when read in conjunction with the accompanying drawings in which:

FIG. 18 illustrates a side-view of an aerosol actuator according to various embodiments of the invention;

FIG. 19 illustrates a front view of an aerosol actuator according to various embodiments of the invention;

FIG. 20 illustrates a cross-sectional view of an aerosol actuator according to embodiments of the invention;

DETAILED DESCRIPTION OF THE INVENTION

Figure 1:
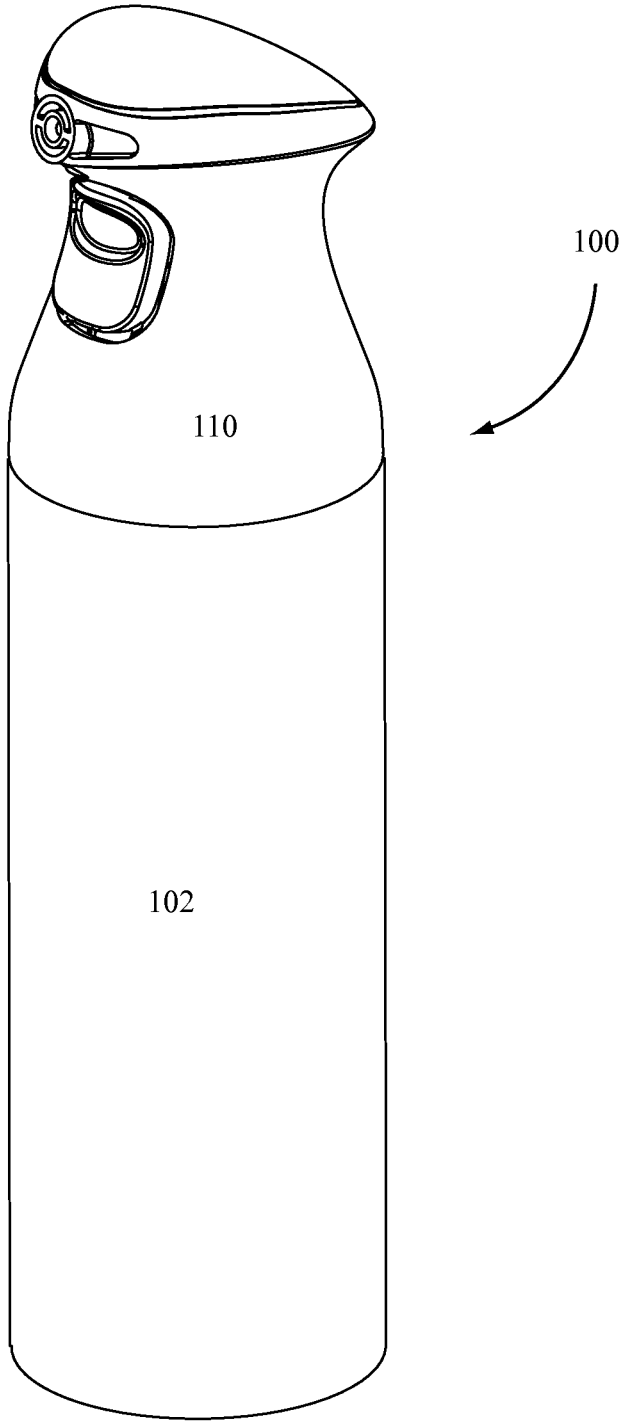
FIG. 1 illustrates an aerosol actuation system according to embodiments of the invention.

According to particular embodiments of the invention, an aerosol actuation system 100 may include an aerosol actuator 110 and an aerosol container 102 as illustrated in FIG. 1. The aerosol actuator 110 may be connected to the aerosol container 102 using any conventional means, methods, or connection systems. The aerosol container 102 may be of any size and may contain, or be adapted to contain, a product which can be dispensed from the aerosol container 102. For example, the aerosol container 102 may contain any product typically dispensed using traditional aerosol systems.

Figure 2:
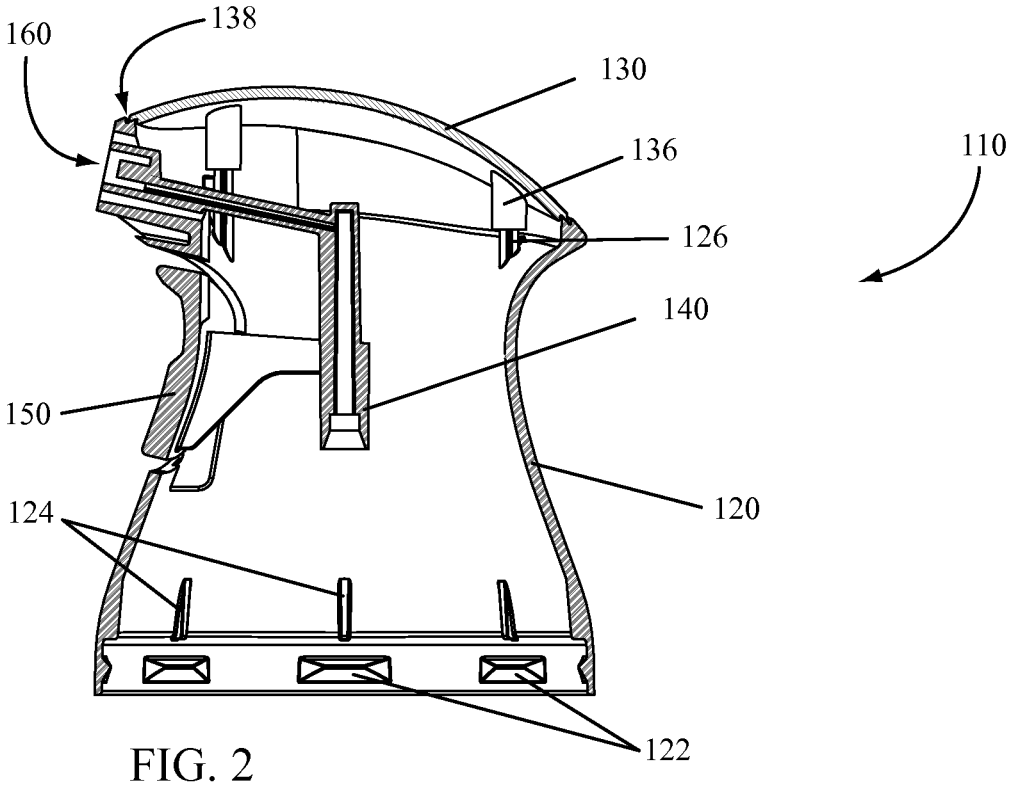
FIG. 2 illustrates a cross-sectional view of an aerosol actuator according to embodiments of the invention.

FIG. 2 illustrates a cross-sectional view of an aerosol actuator 110 according to various embodiments of the invention. The aerosol actuator 110 may include a housing 120, a cap 130, a manifold 140, and a button 150 or trigger.

The housing 120 may include one or more attachment mechanisms for attaching the aerosol actuator 110 to an aerosol container 102. For example, as illustrated in FIG. 2, the housing 120 may include one or more protrusions 122 configured to hold the aerosol actuator 110 on an aerosol container 102. The one or more protrusions 122 may snap under a lip or flange of an aerosol container 102 thereby attaching the aerosol actuator 110 to the aerosol container 102. The housing 120 may also be configured with one or more protrusions 122 configured to mate with recesses in an aerosol container 102. In some embodiments, the housing may also be configured with one or more supports 124 as illustrated in FIG. 2. The one or more supports 124 may rest on a portion of the aerosol container 102. The supports 124 may provide strength to the housing 120 or improve the amount of loading forces that may be applied to an aerosol actuation system 100. The supports 124 may also facilitate the connection between the aerosol actuator 110 and an aerosol container 102.

According to embodiments of the invention, the housing 120 of an aerosol actuator 110 may be formed in any desired shape and size. For example, the aerosol actuator 110 illustrated in FIG. 2 may be configured to fit on large aerosol containers 102 or small aerosol containers 102. The dimensions of the housing 120 and other components of the aerosol actuator 110 may be scaled according to the desired use and to the desired aerosol container 102 size.

In various embodiments of the invention, a cap 130 may be connected to the housing 120. For example, the cap 130 illustrated in FIG. 2 may be snap-fitted to the housing 120 along an upper edge of the housing 120 and an edge 138 of the cap 130. The housing 120 and cap 130 may include complementary fittings or other features allowing a cap 130 to be snap-fitted or otherwise connected to the housing 120. In other embodiments, the housing 120 and cap 130 may include complementary surfaces allowing the cap 130 to rest against the housing 120 or be supported by the housing 120.

In some embodiments of the invention, the housing 120 may include one or more housing support structures 126. A cap 130 may include one or more complementary cap support structures 136. The one or more housing support structures 126 and cap support structures 136 may fit together to connect the cap 130 to the housing 120. For example, as illustrated in FIG. 2, the housing support structures 126 may mate, fit in, or otherwise connect with the cap support structures 136 to hold the cap 130 on the housing 120. While particular housing support structures 126 and cap support structures 136 are illustrated in FIG. 2, it is understood that other such structures or connective parts may be used. For instance, the cap support structures 136 may include snap-fit hooks which may snap into snap-fitments in the housing 120 to secure the cap 130 to the housing 120.

Additional support structures or connective elements may also be used to connect a cap 130 to a housing 120 according to embodiments of the invention. For example, the aerosol actuator 110 illustrated in FIG. 3 includes a cap connection post 137 and a housing connection support 127. The cap connection post 137 may snap into the housing connection support 127 to help secure the cap 130 to the housing 120. In other embodiments, the cap connection post 137 may fit with or be secured to the housing connection support 127 in any other desired manner. Similarly, the housing 120 may include a housing connection post which mates with or connects with a cap connection support (not shown) to secure or support a connection between the cap 130 and the housing 120.

A housing 120 according to embodiments of the invention may also include a discharge orifice 160 as illustrated in FIG. 2. The discharge orifice 160 may be molded with the housing 120 and may define a passage through which a product and/or an aerosol are ejected from the aerosol actuator 110 in an aerosol actuation system 100. The discharge orifice 160 may include any desired shape or size and may be customized to produce particular spray patterns.

Figure 3:
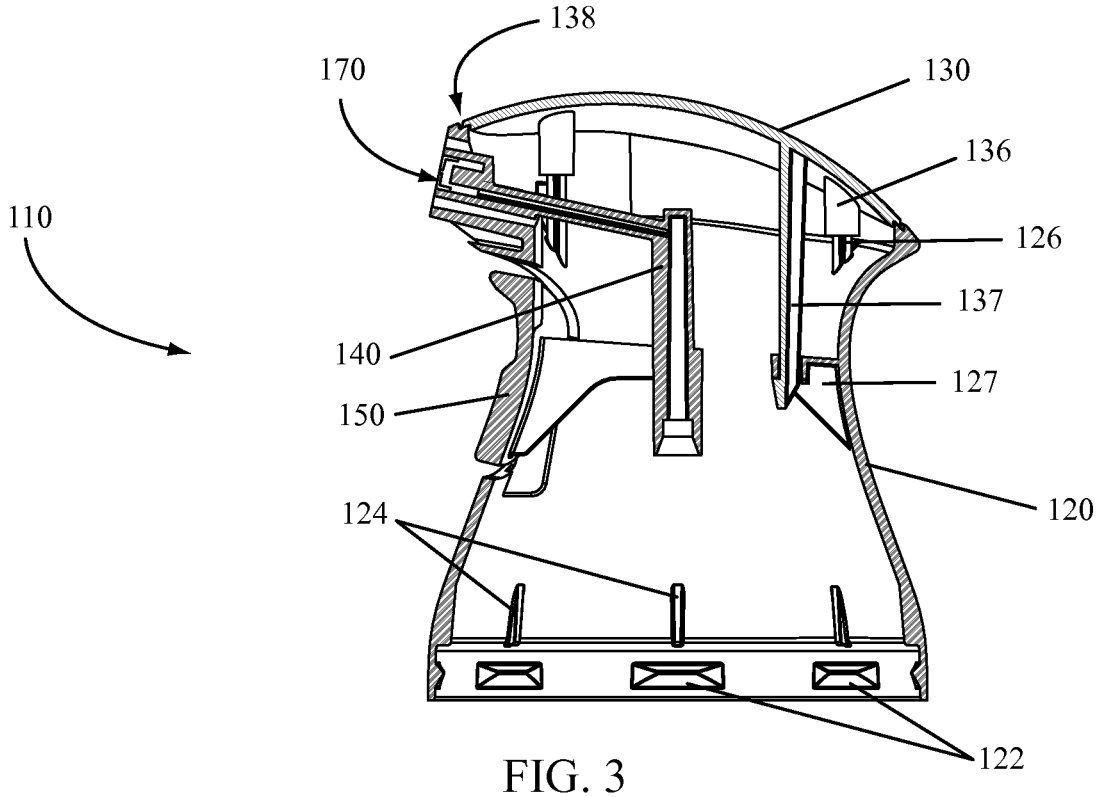
FIG. 3 illustrates a cross-sectional view of an aerosol actuator according to embodiments of the invention.

In some embodiments of the invention, an orifice cup 170 may be assembled with the discharge orifice 160 as illustrated in FIG. 3. An orifice cup 170 may provide an aerosol actuation system 100 with a particular spray pattern. For example, if a broad spray pattern is desired, an orifice cup 170 configured to produce such a spray pattern may be assembled with the housing 120 in the discharge orifice 160 to provide such a pattern. If an alternative pattern is desired, a different orifice cup 170 could be assembled or inserted into the discharge orifice 160 to provide the desired pattern. In this manner, the spray patterns produced by an aerosol actuation system 100 according to embodiments of the invention may be customized to the desired use for the aerosol actuation system 100 or to the product that will be dispersed by the aerosol actuation system 100.

Figure 4:
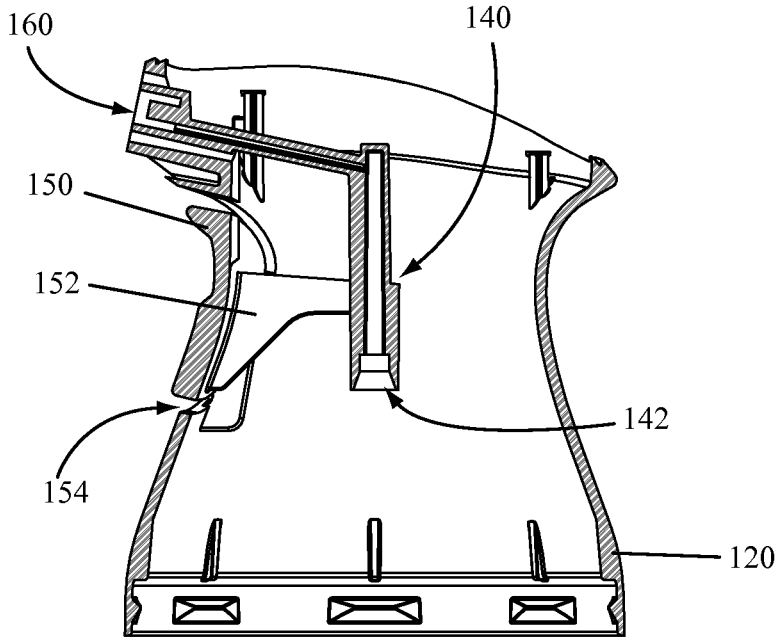
FIG. 4 illustrates a cross-sectional view of an aerosol actuator housing according to embodiments of the invention.

According to certain embodiments of the invention, the manifold 140, the button 150, or the manifold 140 and the button 150 may be integral with the housing 120 or integrally formed with the housing 120. For example, FIG. 4 illustrates a cross-sectional view of a housing 120 according to embodiments of the invention wherein the manifold 140 and the button 150 have been integrally molded with the housing 120. The manifold 140 may be connected to the housing 120 in any desired manner. In some embodiments, connections between the manifold 140 and the housing 120 may be molded to allow the manifold 140 to flex. In other embodiments, connections between the manifold 140 and housing may hold at least a part of the manifold 140 in a rigid position. The manifold 140 may include a valve connection 142 having an opening configured to mate with a valve of an aerosol container 102. A passage through the manifold 140 may lead from the valve connection 142 to the discharge orifice 160. Product may flow through the passage from a valve of an aerosol container 102 and out the discharge orifice 160.

According to some embodiments of the invention, the button 150 may be connected to the manifold 140 by an actuation connection 152. The actuation connection 152 may be any shape and may connect the button 150 with the manifold 140 in one, two, or more locations. For instance, the actuation connection 152 illustrated in FIG. 4 includes an arm connecting one side of the button 150 with one side of the manifold 140. An arm on the other side of the button 150, not shown in the cross-sectional view, would connect a second side of the button 150 to the manifold 140. Other connections between the manifold 140 and button 150 may be used as desired.

The button 150 may also be integral with or connected to the housing 120. The button 150 may be molded to include one or more button connections 154 to the housing 120. The button connections 154 may be configured so that the button connections 154 are permanent or so that the button connections 154 break-away or separate from the housing 120 or button 150. When the button connections 154 are permanent, the button connections 154 may flex or allow the button 150 to flex when a force is applied to the button 150 such that the force applied to the button 150 is at least partially transferred to the manifold 140, for example, through an actuation connection 152. The force applied to the manifold 140 may move the manifold 140 and a valve of an aerosol container 102 attached to the valve connection 142. If sufficient force is applied, the movement of the valve connection 142 may open the valve of an aerosol container 102 allowing a product and/or an aerosol to escape the aerosol container 102 through the manifold 140 and out the discharge orifice 160.

In various embodiments of the invention the button connections 154 may be configured to break or separate from the housing 120 upon activation of the button 150. In such embodiments, the actuation connection 152 may connect the button 150 to the manifold 140. When a force is applied to the button 150, the button 150 may move the actuation connection 152 and the manifold 140. When the manifold 140 is moved a sufficient distance, the manifold 140 may open a valve of an aerosol container 102 connected to the manifold at the valve connection 142. When the force being applied to the button 150 is reduced or removed, the spring forces or rigidity of the manifold 140 may allow the manifold 140 to relax back into its original position wherein the valve of the aerosol container 102 is closed. The relaxation of the manifold 140 may also move the button 150 close to its original position. Thus, the manifold 140 may act as a spring to return the button 150 to a position within the housing 120.

While the button connections 154 are illustrated in a particular location in FIG. 4, it is understood that the button connections 154 may be located in any desired position about the button 150 or in contact with the button 150. In addition, the button connections 154 may be formed as an integral spring or force resisting structure such that when a force being applied to the button 150 is released or reduced, the button connection 154 may return the button 150 to a starting position or a position where sufficient force is not being applied to the manifold 140 to open a valve of an aerosol container 102 and allow product to escape.

Figure 23:
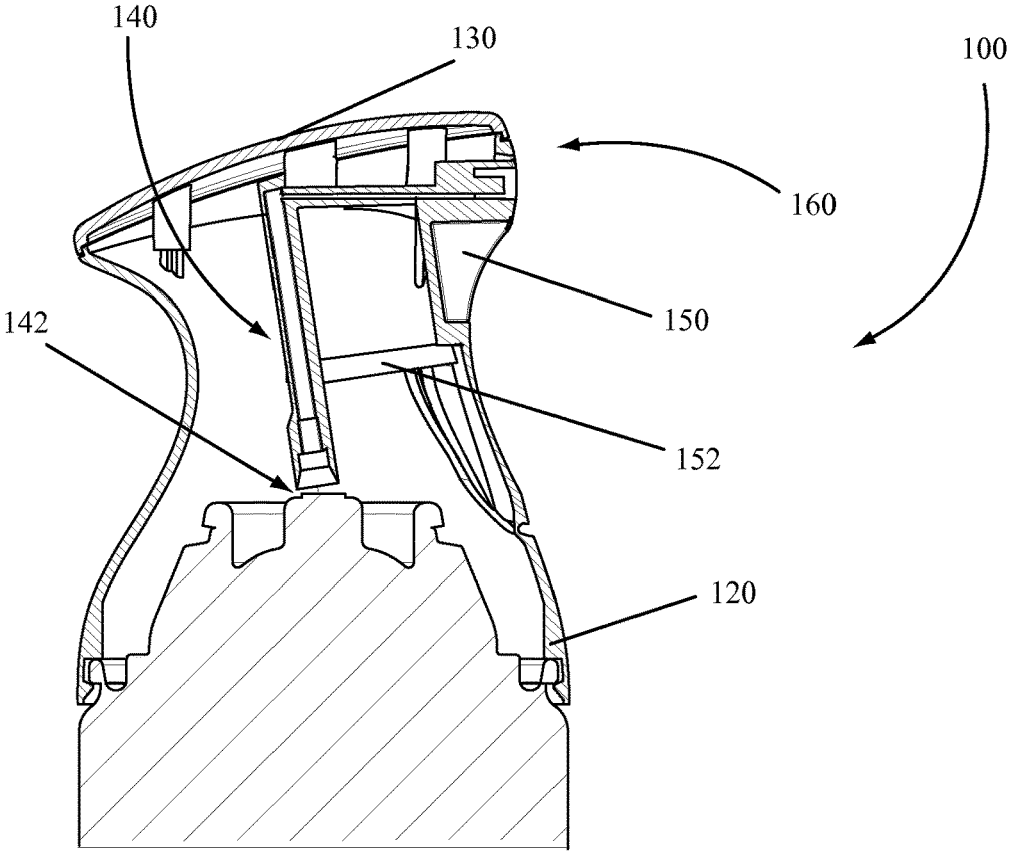
FIG. 23 illustrates a cross-sectional view of an aerosol actuation system according to embodiments of the invention.
Figure 24:
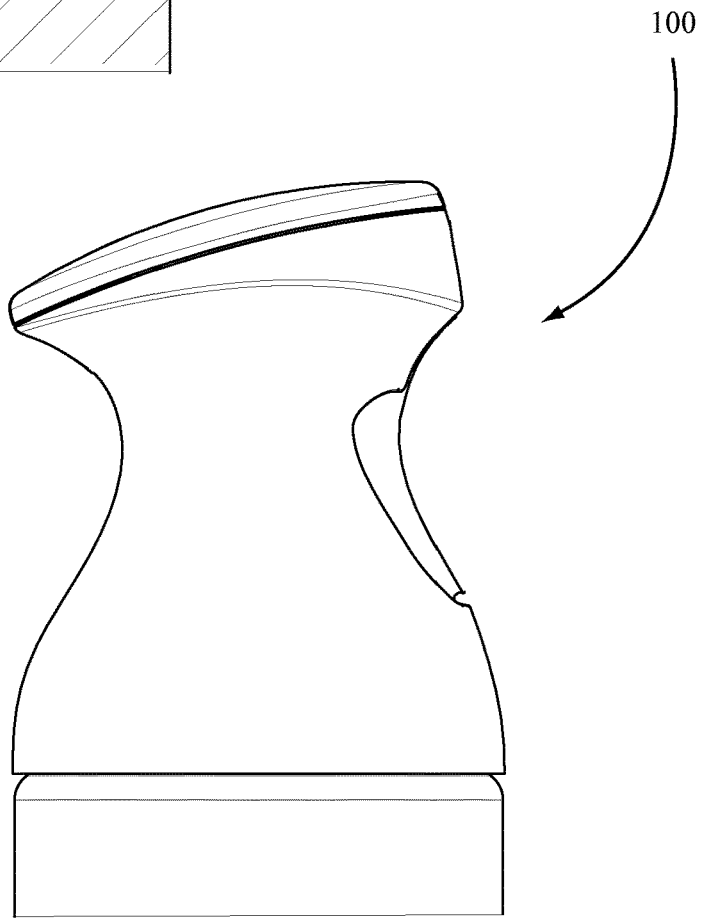
FIG. 24 illustrates an aerosol actuation system according to embodiments of the invention.

According to some embodiments of the invention, an aerosol actuation system 100 may include a button 150, manifold 140, and housing 120 formed as a single component as illustrated in FIG. 23. A cap 130 may enclose the interior of the aerosol actuation system 100. The button 150 and manifold 140 of the aerosol actuation system 100 illustrated in FIG. 23 may move upon actuation of the button 150 such that the discharge orifice 160 moves in response to actuation of the button 150. FIG. 24 illustrates the aerosol actuation system 100 shown in FIG. 23.

Figure 25:
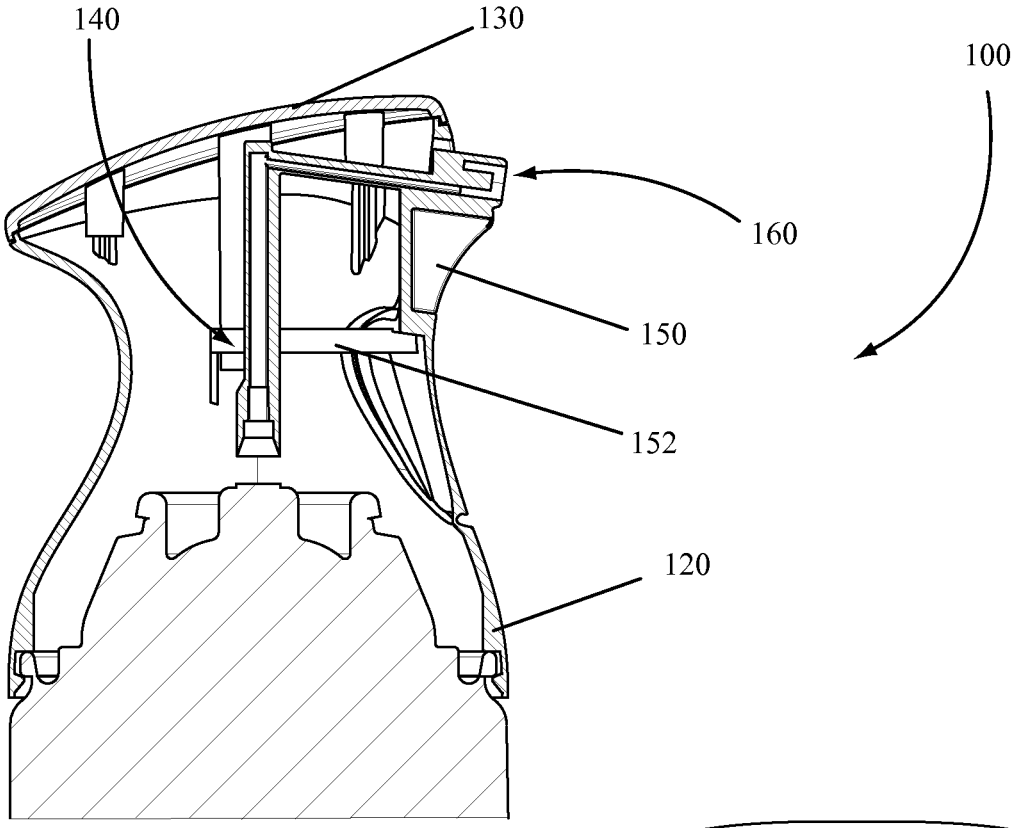
FIG. 25 illustrates a cross-sectional view of an aerosol actuation system according to embodiments of the invention.
Figure 26:
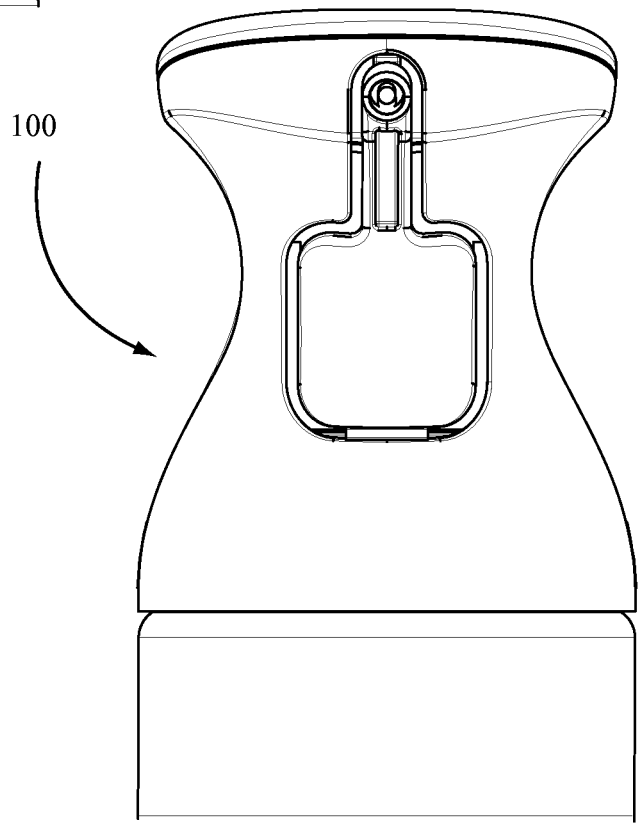
FIG. 26 illustrates an aerosol actuation system according to embodiments of the invention.

Another embodiment of an aerosol actuation system 100 according to embodiments of the invention is illustrated in FIGS. 25 and 26. The cross-sectional view of the aerosol actuation system 100 shown in FIG. 25 illustrates the button 150, manifold 140 and housing 120 which are formed from a single piece of material, such as a molded plastic material. As the button 150 is actuated or pushed, the manifold 140 moves in response to the button 150 movement and disperses a product from a container. The discharge orifice 160, including an orifice cup if desired, may move in response to forces applied to the button 150. FIG. 26 illustrates the aerosol actuation system 100 shown in FIG. 25.

In still other embodiments of the invention, the button 150 may be connected to the manifold 140 through one or more actuation connections 152 but not to the housing 120. For example, the aerosol actuator illustrated in FIG. 5 does not include any connections between the button 150 and the housing 120. When a force is applied to the button 150, the actuation connections 152 move the manifold 140, which may activate or open a valve of an aerosol container 102. When the force is released, the manifold 140 or a spring force integral with the manifold 140 may move the manifold 140 back to an original position, closing the valve and moving the button 150 back to a pre-actuation position.

Figure 5:
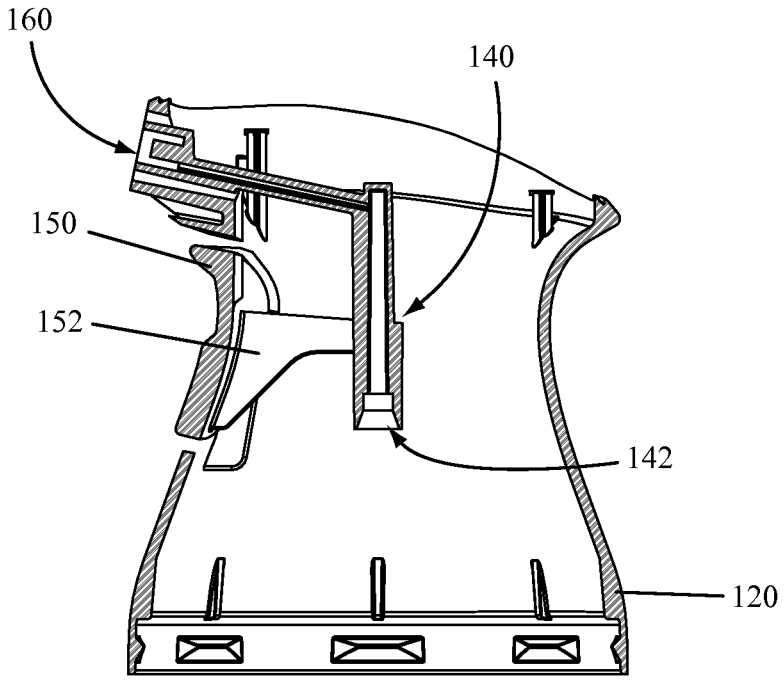
FIG. 5 illustrates a cross-sectional view of an aerosol actuator housing according to embodiments of the invention.

According to embodiments of the invention, the aerosol actuator 110 components illustrated in FIGS. 4 and 5 may be molded in a single piece or component. For instance, the housing 120, manifold 140, and button 150 assemblies illustrated in FIGS. 4 and 5 may be formed by injection molding polypropylene or other resin or plastic material in a mold assembly. The molded housing 120, manifold 140, and button 150 may then be assembled with a cap 130 and connected to an aerosol container 102 to form an aerosol actuation system 100 according to embodiments of the invention.

Figure 6:
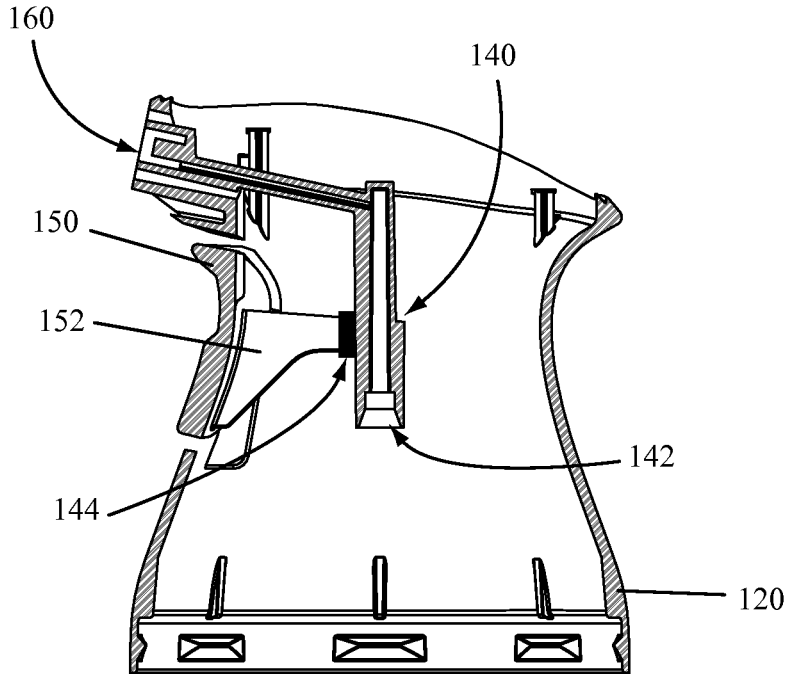
FIG. 6 illustrates a cross-sectional view of an aerosol actuator housing according to embodiments of the invention.

In other embodiments of the invention, as illustrated in FIG. 6, the manifold 140 may be integral with the housing 120. The manifold 140 may include one or more button connectors 152 wherein a button 150 or an actuation connection 152 may be connected to the manifold 140 and housing 120 assembly. For example, the button 150 and actuation connection 152 illustrated in FIG. 6 may be molded as a single piece and the manifold 140 and housing 120 may be molded as a second piece. The button 150 and actuation connection 152 may be snap-fit or otherwise assembled or connected to the manifold 140 at the button connectors 142 on the manifold 140. In other embodiments, the actuation connection 152 may be molded with the manifold 140 and a button 150 may be snap-fit or otherwise assembled or connected to the actuation connection 152. In these particular embodiments, the housing 120 and manifold 140 may be molded as a first piece and the button 150 or button 150 and actuation connection 152 as a second piece from polypropylene or other plastic or resin material. The two pieces may then be assembled with a cap 130 to produce an aerosol actuator 110 according to embodiments of the invention.

Figure 7:
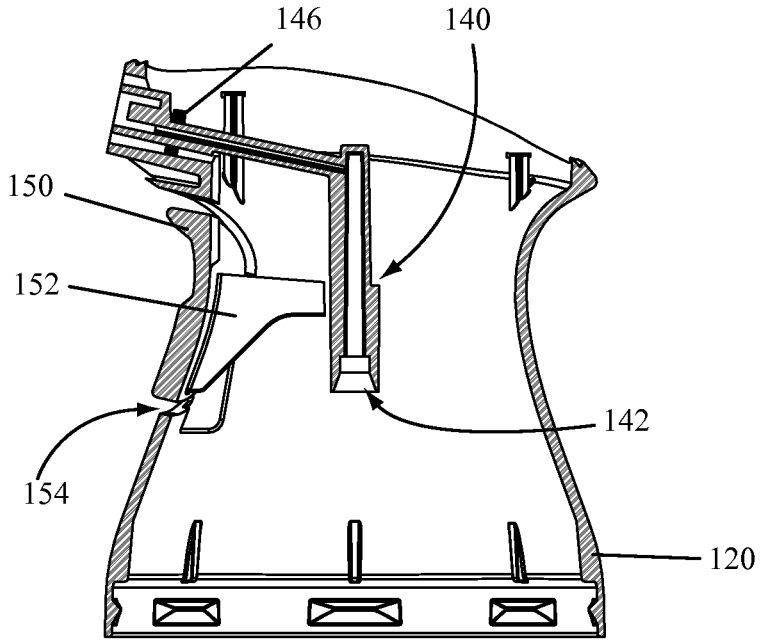
FIG. 7 illustrates a cross-sectional view of an aerosol actuator housing according to embodiments of the invention.

According to still other embodiments of the invention, the button 150 may be integral with the housing 120 as illustrated in FIG. 7. The button 150 may be molded with the housing 120 and may include one or more button connections 154 connecting the button 150 to the housing 120. The actuation connections 152 may also be formed or molded with the button 150. However, the manifold 140 may be molded as a separate piece and then inserted, assembled, or otherwise connected to the housing 120. For example, as illustrated in FIG. 7, the manifold 140 may be snap-fit to the housing 120 with a manifold snap-fitment 146 which may be molded with the housing 120. In such embodiments, the housing 120 and button 150 may be molded and then assembled with a manifold 140 molded separately. The manifold 140 may be secured with the housing 120 using any desired methods. A cap 130 may then be attached to the assembly to form an aerosol actuator 110 according to embodiments of the invention.

As illustrated in FIG. 7, the button 150 and the actuation connections 152 may not actually connect with the manifold 140 according to some embodiments of the invention. The button 150 and the actuation connections 152 may be configured such that actuation of the button 150 or the application of force to the button 150 moves the actuation connections 152 such that the actuation connections 152 engage the manifold 140. The engagement of the manifold 140 and the actuation connections 152 may move the manifold 140 and actuate a valve of an aerosol container 102.

According to certain embodiments of the invention, an aerosol actuator 110 may be assembled from two parts. For example, a housing 120 molded with a manifold 140, a button 150, and a discharge orifice 160 may be assembled with a separately molded cap 130. The assembled aerosol actuator 110 may be snap-fitted onto an aerosol container 102 having a valve. The valve may mate with the manifold 140, providing a ready-to-use aerosol actuation system 100.

Figure 8:
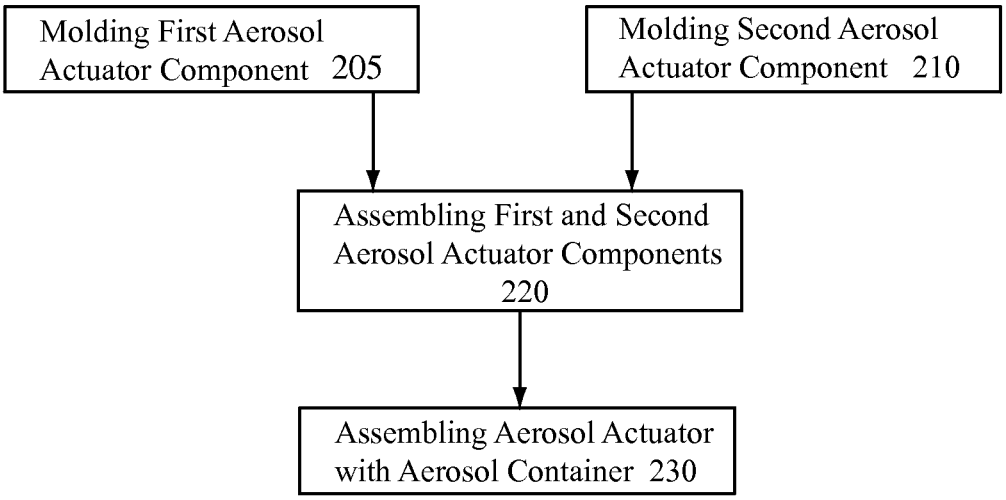
FIG. 8 illustrates a process flow diagram of a method for making an aerosol actuator according to embodiments of the invention.

A method for making an aerosol actuator 110 according to various embodiments of the invention is illustrated in FIG. 8. According to certain embodiments of the invention, a method for making an aerosol actuator 110 may include the molding of a first aerosol actuator component 205 and the molding of a second aerosol actuator component 210. The first aerosol actuator component may include a housing 120, a manifold 140 and a button 150 according to embodiments of the invention. The second aerosol actuator component may include a cap 130. The first aerosol actuator component and the second aerosol actuator component may be assembled together 220 to form an aerosol actuator 110 according to embodiments of the invention. The aerosol actuator 110 and an aerosol container 102 may be assembled together 230 to form an aerosol actuation system 100 according to embodiments of the invention. The aerosol container 102 may be filled prior to, during, or after assembly with the aerosol actuator 110. The assembled aerosol actuator 110 may also be shipped to a filling line or warehouse where aerosol actuator 110 may be assembled with aerosol containers 102.

According to other embodiments of the invention, an aerosol actuator 110 may be assembled from three parts. A housing 120 molded with a manifold 140 and a button 150 may be assembled with a cap 130 as illustrated in FIG. 2. An orifice cup 170 may be assembled or attached to the discharge orifice 160 as illustrated in FIG. 3.

Figure 9:
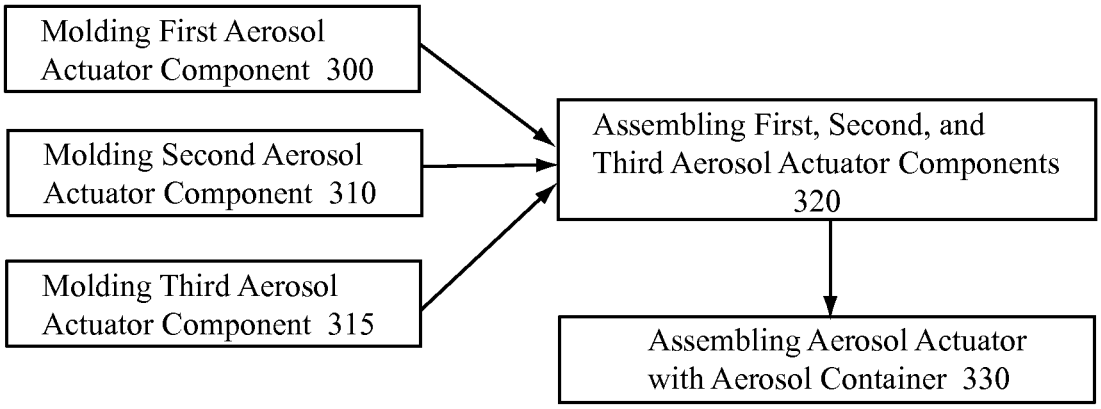
FIG. 9 illustrates a process flow diagram of a method for making an aerosol actuator according to embodiments of the invention.

FIG. 9 illustrates a method for making an aerosol actuator 110 according to other embodiments of the invention. A first aerosol actuator component is molded 300; a second aerosol actuator component is molded 310; and a third aerosol actuator component is molded 315. The first, second, and third aerosol actuator 110 components may then be assembled 320 to form an aerosol actuator 110. The aerosol actuator 110 may then be assembled with an aerosol container 102 prior to, during, or after filling of the aerosol container 102. In some embodiments of the invention, where the third aerosol actuator component is an orifice cup 170, the assembly of the third aerosol actuator component may be undertaken after the assembly of the aerosol actuator 110 with the aerosol container 102.

According to various embodiments of the invention, the different components of an aerosol actuator 110 may be formed from different colored materials. For example, an aerosol actuator 110 may include a housing 120 having a first color and a cap 130 having a second, different, color. In some embodiments of the invention, various components of a single molded component may also have different colors. For instance, a button 150 may be molded to a housing 120 using a bi-injection molding process wherein the button 150 is molded with a different colored material than the rest of the housing 120. Bi-injection molding processes may also be used with embodiments of the invention to form aerosol actuators 110 having different material components.

Figure 10:
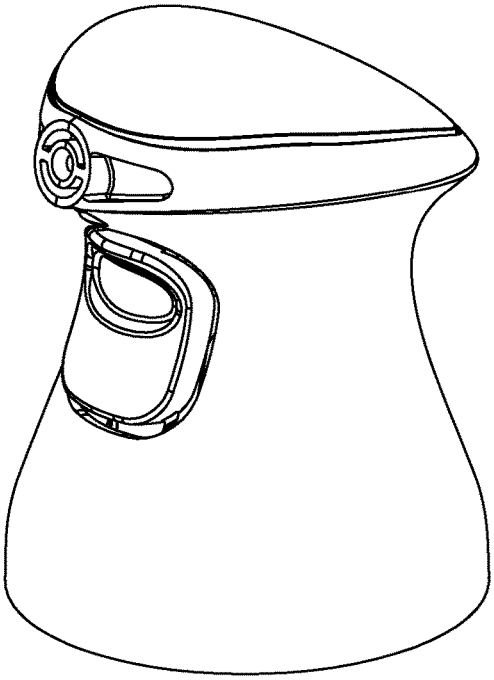
FIG. 10 illustrates a perspective view of an aerosol actuator according to certain embodiments of the invention.
Figure 11:
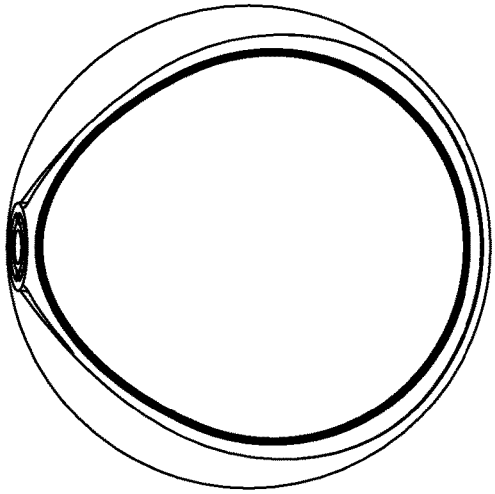
FIG. 11 illustrates a top-down view of an aerosol actuator according to certain embodiments of the invention.
Figure 12:
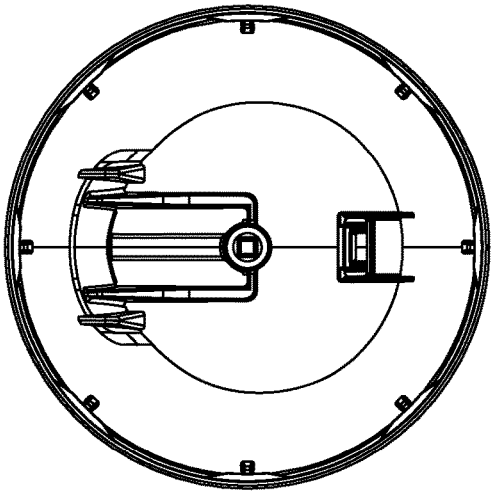
FIG. 12 illustrates a bottom view of an aerosol actuator according to certain embodiments of the invention.
Figure 13:
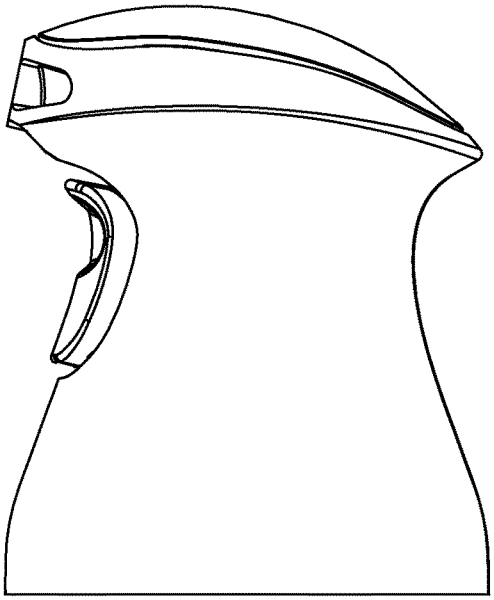
FIG. 13 illustrates a side view of an aerosol actuator according to certain embodiments of the invention.
Figure 14:
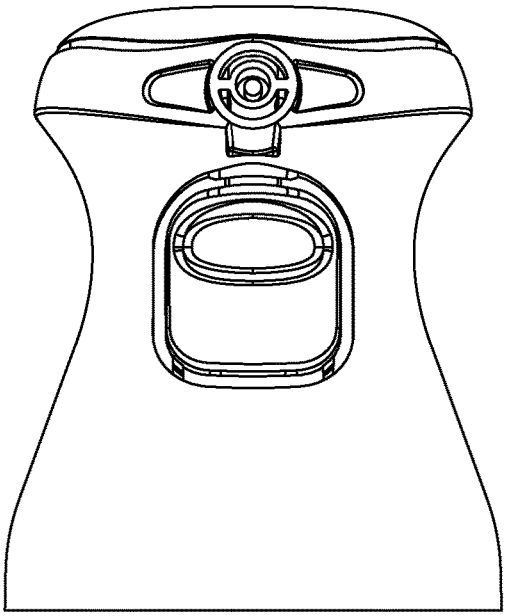
FIG. 14 illustrates a front view of an aerosol actuator according to certain embodiments of the invention.
Figure 15:
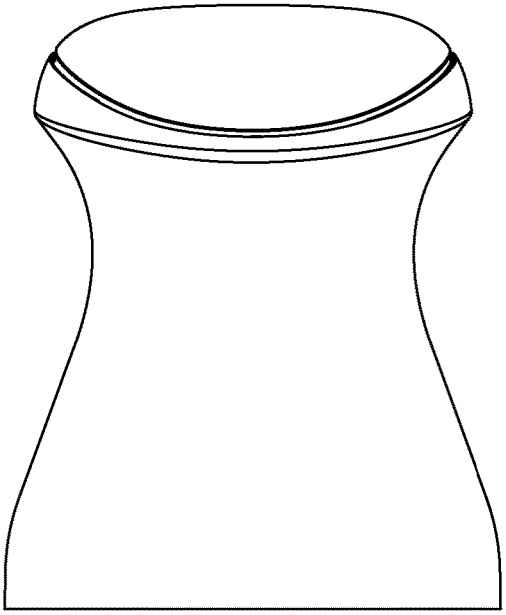
FIG. 15 illustrates a rear view of an aerosol actuator according to certain embodiments of the invention.
Figure 16:
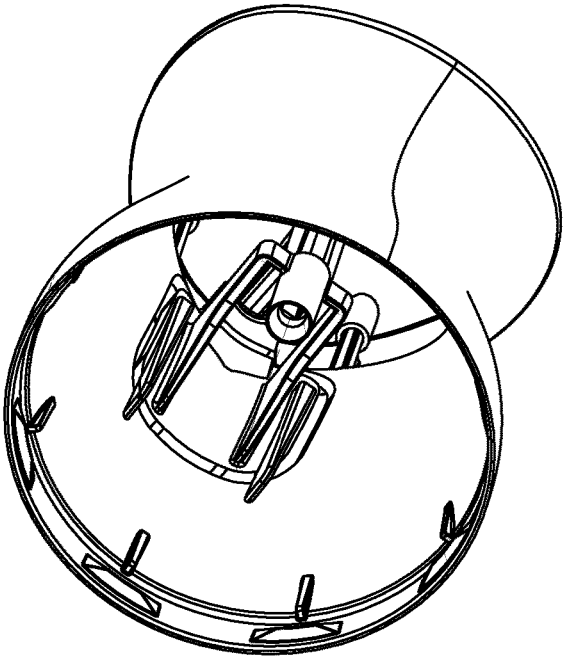
FIG. 16 illustrates a bottom perspective view of an aerosol actuator according to certain embodiments of the invention.
Figure 17:
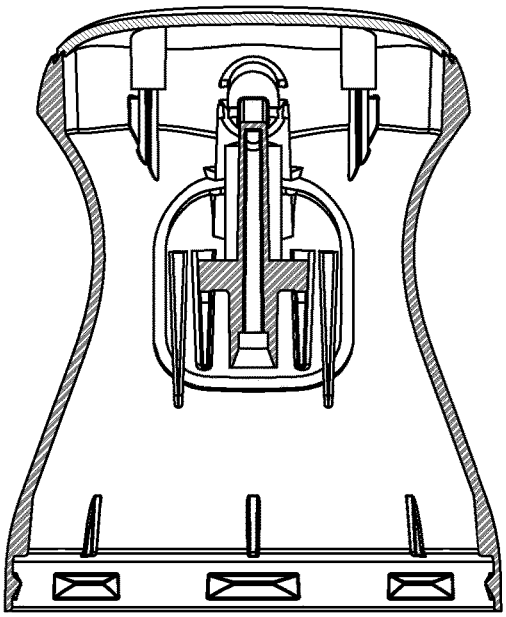
FIG. 17 illustrates a rear cross-sectional view of an aerosol actuator according to certain embodiments of the invention.

An assembled aerosol actuator 110 according to various embodiments of the invention is illustrated in FIGS. 10 through 17. FIG. 10 illustrates a perspective view of an aerosol actuator 110 according to embodiments of the invention. FIG. 11 illustrates a top view of an aerosol actuator according to embodiments of the invention. FIG. 12 illustrates a bottom view of an aerosol actuator according to embodiments of the invention. FIG. 13 illustrates a side view of an aerosol actuator according to embodiments of the invention. FIG. 14 illustrates a front view of an aerosol actuator according to certain embodiments of the invention. FIG. 15 illustrates a rear view of an aerosol actuator according to certain embodiments of the invention. FIG. 16 illustrates a bottom perspective view of an aerosol actuator according to certain embodiments of the invention. FIG. 17 illustrates a rear cross-sectional view of an aerosol actuator according to certain embodiments of the invention.

An aerosol actuator according to other embodiments of the invention is illustrated in FIGS. 18 through 21. As illustrated in FIG. 18, an aerosol actuator 210 according to embodiments of the invention may include an integrated button or trigger 250, manifold 240, and discharge orifice 260. A front view of the aerosol actuator 210 is illustrated in FIG. 19. A cross-sectional view of an aerosol actuator 210 according to certain embodiments of the invention is illustrated in FIG. 20. As illustrated in FIG. 20, the manifold 240, trigger 250, and discharge orifice 260 may be molded as a single piece or component that may be used in or with an aerosol actuation system 200. The molded component may be molded from a resin, plastic, composite, metal, or other material.

Figure 21:
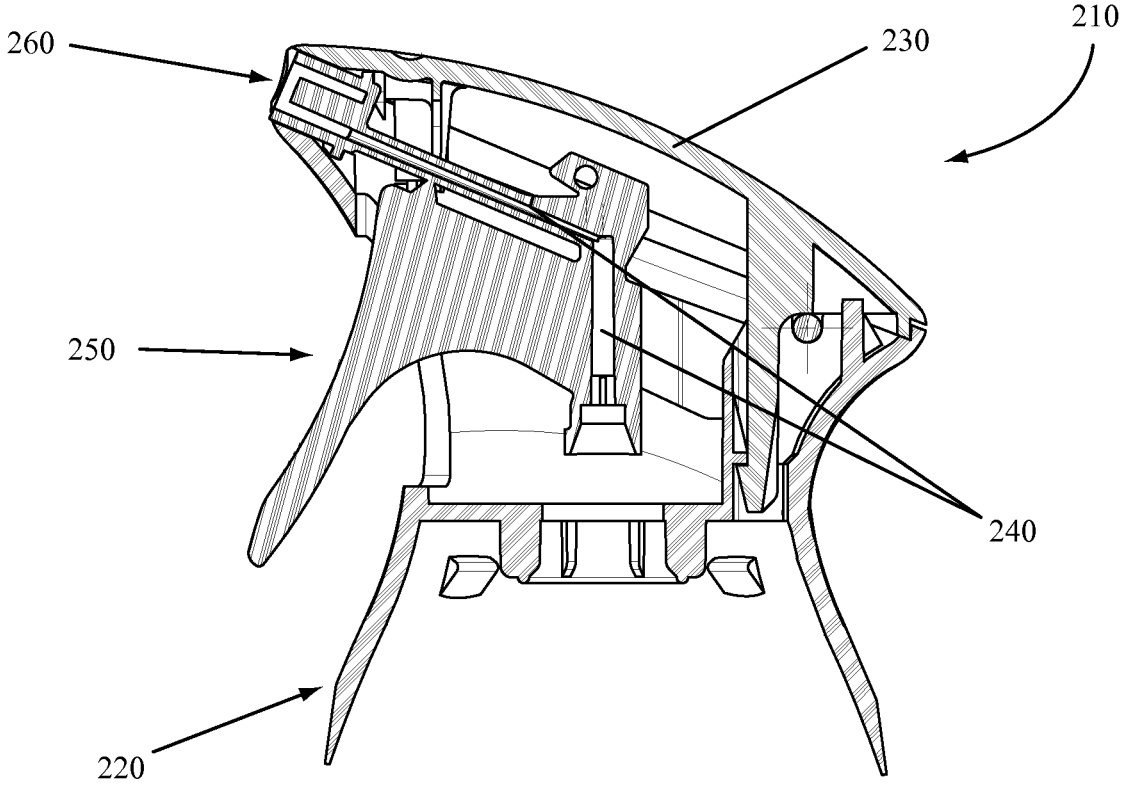
FIG. 21 illustrates a cross-sectional view of an aerosol actuator according to embodiments of the invention.

FIG. 21 illustrates a cross-sectional view of an aerosol actuator 210 according to certain embodiments of the invention. The aerosol actuator 210 may include a single component manifold 240, trigger 250, and discharge orifice 260 fitted or otherwise situated in a housing 220 with a cap 230. Activation of the trigger 250 may move the manifold 240 which may activate a valve of a container 202 to release a gas, a liquid, both a gas and liquid, or an aerosol product from the container 202 through the manifold 240 and discharge orifice 260. According to embodiments of the invention, a one-piece trigger 250, manifold 240, and discharge orifice 260 component of an aerosol actuator 210 may be used in place of a multi-component trigger and manifold configuration in order to reduce the component count of an aerosol actuator 210 or aerosol actuation system 200.

Figure 22:
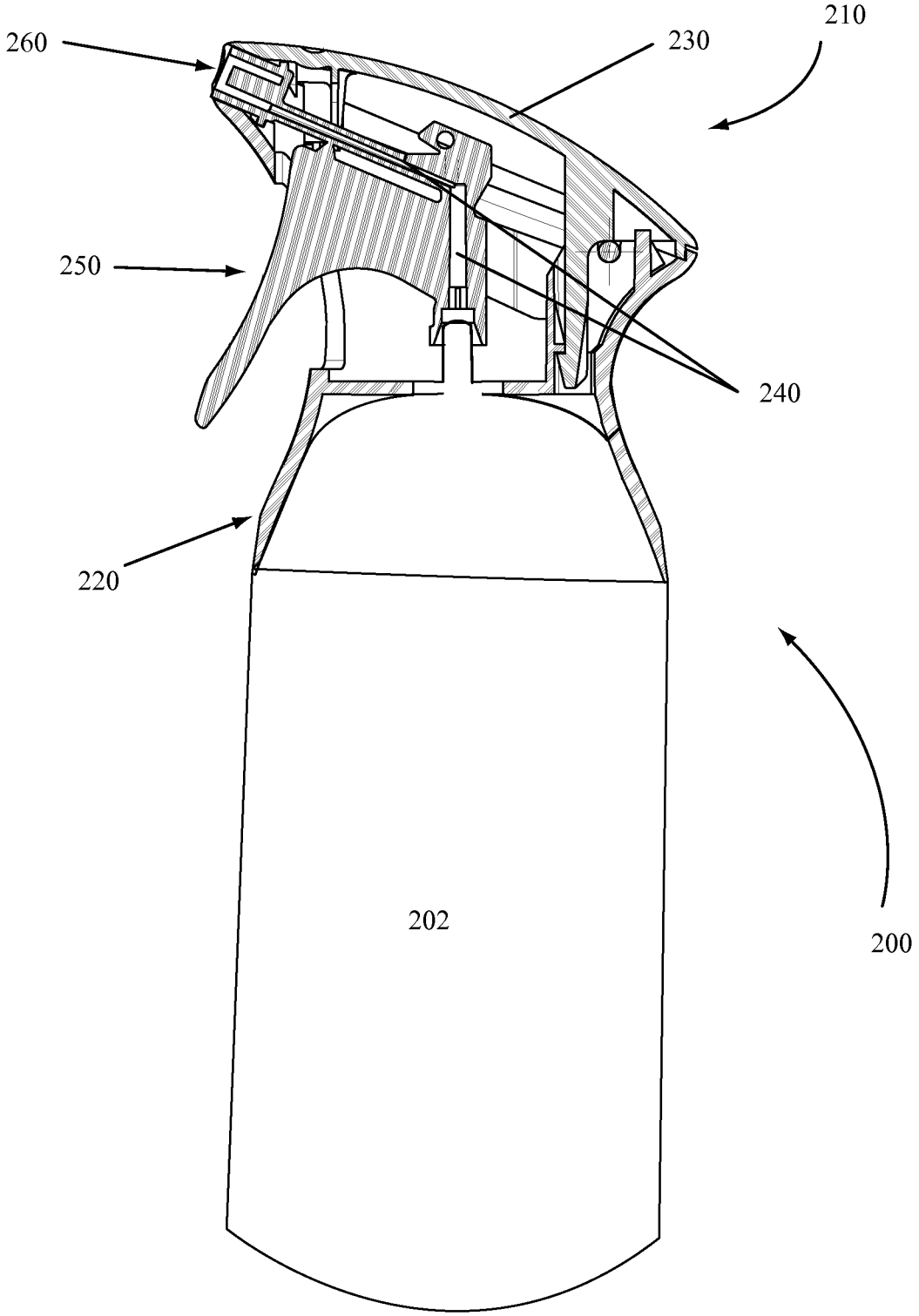
FIG. 22 illustrates a cross-sectional view of an aerosol actuation system according to embodiments of the invention.

According to embodiments of the invention, an aerosol actuator 210 may be constructed or assembled by attaching or resting a one-piece trigger 250, manifold 240, and discharge orifice 260 in a housing 220. A cap 230 placed over the housing 220, or otherwise attached or snap-fitted to the housing 220, may enclose the one-piece activation component within the housing 220 such that the trigger 250 portion is accessible. Activation of the trigger 250 may move the manifold 240 which may activate a valve on a container 202. For example, the aerosol actuation system illustrated in FIG. 22 may be activated to disperse a gas, liquid, both liquid and gas, or an aerosol from the container 202 by activating the trigger 250 of the aerosol actuator 210.

According to other embodiments of the invention, the discharge orifice 260 may be fitted with one or more orifice cups to customize the spray from the aerosol actuator.

While various embodiments of the invention have been described with respect to particular aesthetic designs illustrated in the Figures, it is understood that aerosol actuation systems according to embodiments of the invention may include other aesthetic designs. It is also understood that portions of the aerosol actuation systems according to embodiments of the invention may be incorporated with other aerosol actuation systems.

In addition, aerosol actuation systems according to embodiments of the invention are not limited to actuation buttons or triggers on the front of the aerosol actuator. An aerosol actuator may include an actuation button, buttons, trigger, or triggers on the side of the aerosol actuator or the rear of the aerosol actuator, or any combination thereof.

Having thus described certain particular embodiments of the invention, it is understood that the invention defined by the appended claims is not to be limited by particular details set forth in the above description, as many apparent variations thereof are contemplated. Rather, embodiments of the invention include within their scope all equivalent devices or methods which operate according to the principles of the invention as described.

What is claimed is:

1. An aerosol actuation system, comprising:

a housing, comprising:

a housing upper opening;

a plurality of housing support structures;

a housing lower opening opposite the housing upper opening, and a plurality of protrusions extending radially inward from the housing lower opening, the plurality of protrusions are configured to connect the aerosol actuation system to a container; and a button opening on a front surface of the housing, wherein the button opening is bounded on all sides by the housing;

a button positioned in the button opening and having a shape coextensive with the button opening, and;

a manifold including a discharge orifice; and a cap comprising a plurality of cap support structures, wherein each of the plurality of cap support structures is received in interfitting mated relation with a respective one of the plurality housing support structures to hold the cap on the housing;

wherein the button and manifold are both integrally molded with the housing, the manifold including a flexible connection to the housing at a first location proximate the discharge orifice, and the button including at least one permanently connected flexible connection between the button and the housing at a second location, and the button including a connection to the manifold at a third location, the at least one permanently connected connection between the button and the housing being arranged and configured to flex upon actuation of the button, relative to the housing, to transfer force to the manifold; and wherein the button is pivotably connected to the housing at the first location.

2. The aerosol actuation system of claim 1, further comprising a breakable connection between the button and the housing.

3. The aerosol actuation system of claim 1, further comprising an aerosol container attached to the housing.

4. The aerosol actuation system of claim 1, wherein the manifold comprises:

a valve connection; and a pathway from the valve connection to the discharge orifice, wherein the manifold is connected to the housing at the discharge orifice.

5. An aerosol actuation system, comprising:

a molded housing, comprising:

a housing upper opening circumscribed by an upper edge;

a housing lower opening opposite the housing upper opening, and a plurality of protrusions extending radially inward from the housing lower opening, the plurality of protrusions are configured to connect the aerosol actuation system to a container;

a button opening on a front surface of the housing bounded completely by the housing;

a manifold integrally molded with the housing, the manifold comprising a valve connection, a discharge orifice, and a pathway from the valve connection to the discharge orifice, the manifold being connected to the housing at the discharge orifice; and a button integrally molded with the housing and positioned within the button opening and further having a shape coextensive with the button opening, the button including a first connection to the manifold and further includes at least one permanently connected connection between the button and the housing at a second connection location, proximate the discharge orifice, the at least one permanently connected connection is arranged and configured to flex upon actuation of the button about the second connection location, relative to the housing, to transfer force to the manifold;

a cap assembled to the upper edge of the housing.

6. The aerosol actuation system of claim 5, further comprising a breakable connection between the button and the housing.

7. The aerosol actuation system of claim 5, further comprising an aerosol container attached to the housing.

* * * * *